US005651565A

United States Patent [19]

Liu

[11] Patent Number: 5,651,565

[45] Date of Patent: Jul. 29, 1997

[54] ADJUSTABLE LENGTH SKI POLE

[75] Inventor: Rick Liu, Wilson, Wyo.

[73] Assignee: Life-Link International, Inc., Jackson, Wyo.

[21] Appl. No.: 494,015

[22] Filed: Jun. 23, 1995

Related U.S. Application Data

[63] Continuation-in-part of Ser. No. 398,560, Mar. 3, 1995, abandoned.

[51] Int. Cl.[6] ..... A63C 11/22

[52] U.S. Cl. ..... 280/823; 135/75

[58] Field of Search ..... 280/819, 820, 280/823; 135/66, 75

[56] References Cited

U.S. PATENT DOCUMENTS

| | | | |
|---|---|---|---|
| 2,275,330 | 3/1942 | Tueten | 280/823 |
| 2,456,205 | 12/1948 | Magder | 280/823 |
| 2,494,878 | 1/1950 | Jensen | 280/823 |
| 4,134,703 | 1/1979 | Hinners | 280/823 X |
| 5,139,284 | 8/1992 | Ronning et al. | 280/823 |
| 5,387,048 | 2/1995 | Kuo | 135/75 X |
| 5,538,354 | 7/1996 | Simond | 280/819 X |

FOREIGN PATENT DOCUMENTS

| | | | |
|---|---|---|---|
| 117835 | 9/1969 | Norway | 280/819 |

*Primary Examiner*—Brian L. Johnson
*Attorney, Agent, or Firm*—Andrew D. Maslow

[57] ABSTRACT

A locking structure for two telescoping tubular members is provided with an outer tube member and an inner tube member slidable inside the outer tube member. An expansion member is located within the outer tube member. The expansion member contains at least two tapered members each having innermost and outermost portions, the outermost portions being spaced no more than ½ inch from each other. On the expansion member is an outer tube pressure member shaped to fit the expansion to member and disposed between said the expansion member and the inner surface of the outer tube member. The expansion member may be attached to the inner tube member. The expansion member is moved in opposite directions inside the outer tube member so that when said expansion member is moved in a first direction, pressure is directly applied to the outer tube pressure member which in turn applies pressure to the inner surface of the outer tube member thereby maintaining the inner and outer tube members in a locked position. When the expansion member is moved in the opposite direction, pressure is relieved from the outer tube pressure member which in turn relieves the pressure exerted on the inner surface of the outer tube member thereby loosening the inner and outer tube members from their previously locked or tightened position.

7 Claims, 5 Drawing Sheets

ADJUSTABLE LENGTH SKI POLE

This application is a continuation in part of application Ser. No. 398,560 filed Mar. 3, 1995, now abandoned.

BACKGROUND OF THE INVENTION

This invention relates to an adjustable length ski pole and, more particularly, to an improved telescopic ski pole which is easily converted into an avalanche probe. The invention provides an improved expansion system for maintaining the adjustable length ski pole at the desired length, easily removable upper grip portions of the poles and means for connecting the lower portions of the poles to each other to form a long probe.

In the prior art there are various types of adjustable length ski poles. Most of them utilize a telescopic tube system. For example, U.S. Pat. Nos. 4,596,405, 4,456,285, 4,448, 422, 3,722,903, 3,712,652, 3,556,544, 4,288,102 and 4,134,703 all utilize two telescopic tubular pole sections. Such telescopic ski poles have generally utilized an expansion nut like system to hold fix the pole at the desired length. The disadvantage of such expansion nut like systems is that they rely on friction of a very limited surface of the expansion nut against the inner wall of the ski pole. This often results in rapid deterioration of the friction bearing surface which can effect the ability of the expansion nut like system to maintain the ski pole at the desired length. Often the expansion nut needs to be replaced for the telescopic function to work properly.

Back country skiers and ski patrol people like to have ski poles that can quickly be converted to an avalanche probe in an emergency. Ira skier is caught and buried in an avalanche and is not quickly located, the skier may suffocate. Avalanche probes are used to push into the snow to locate a buried skier. For many years ski poles which can be connected to each other have been available. U.S. Pat. No. 4,288,102 to Ramer illustrates such an avalanche probe. These ski pole/probes have a male connection at the top of one pole shaft and a female connection at the top of the other pole shaft. When converting such poles to an avalanche probe first a basket is removed from one of the ski poles. Next, both of the ski pole grips are removed. The pole with the male end is connected to the pole with the female end. This effectively doubles the length of the pole. The probe is now ready for use. In order for this system to work quickly in an emergency, the ski pole grips must be easily removable.

SUMMARY OF THE INVENTION

The object of the invention to provide an improved telescoping pole system.

A further object of the invention is to provide an improved telescopic ski pole which can quickly be convened to an avalanche probe.

A still further object of the invention is to provide an improved locking mechanism for telescoping tubes which increases the amount or surface area utilized for a friction based locking mechanism.

Another object of the invention is to provide an improved telescoping ski pole that can be used in connection with narrow diameter carbon fiber shafts.

In accordance with the invention an improved telescopic pole and ski pole grip are provided. The invention is particularly useful for narrow diameter ski pole shafts which are commonly made with a carbon fiber composite material.

A locking structure for two telescoping tubular members is provided with an inner pressure member which is slidable inside the outer tube member. An expansion member is provided within the outer tube member. The expansion member comprises at least two connected tapered members each having a wide and a narrow portion. The wide portions of the tapered members are preferably spaced no more than ½ inch from each other. The inner pressure member which is slidable within the outer tube member is provided and is shaped to fit on the expansion member and is disposed between the expansion member and the inner surface of the outer tube member.

The expansion member is attached to the end of the inner tube member. Means are provided to push the expansion member up or down within the outer tube member. When the expansion member is pushed in a downward direction, the expansion member pushes the pressure member against the inner surface of the outer tube thereby maintaining the inner and outer tubes in a locked position. Similarly, when the expansion member is moved in an upward direction, the pressure previously applied to the inner surface of the outer tube member by the pressure member is relieved, thereby loosening the inner and outer tube members from their previously locked or tightened position.

The moving of the expansion means upward and downward can be accomplished by providing a threaded fitting with the male member attached to the inner tube member and the female member attached to the expansion member or vice versa. In this case, when the inner tube is rotated in a first direction, the expansion member is moved upward within the outer tube member. Similarly, when the inner tube member is rotated in the opposite direction, the expansion member is lowered in the outer tube member. In this case, it is preferable that means are provided to prevent the pressure member from rotating within the outer tube member. This can be accomplished by providing a keying mechanism so that the pressure member fits in a key provided on the outer tube member.

When the locking mechanism is used in a ski pole for use as an avalanche probe the expansion members are detachable from the inner tube member. One pole has an expansion member with an integrated female fitting with the male fitting attached to the inner tube member. The other ski pole has an expansion member with an integrated male fitting with the female fitting attached to its inner tube member. Stop means are provided in the outer tube member to prevent the expansion and pressure means from sliding out of the outer tube member. Thus, when the two inner tube members are unscrewed from their respective expansion members they can be separated from their respective outer tube members and easily attached to each other to form an avalanche probe.

The invention accordingly comprises the features of construction, combination of elements and arrangement of parts which will be exemplified in the construction hereinafter set forth, the scope of the invention will be indicated in the claims.

DETAILED DESCRIPTION OF THE PREFERRED EMBODIMENT

Figure 1:
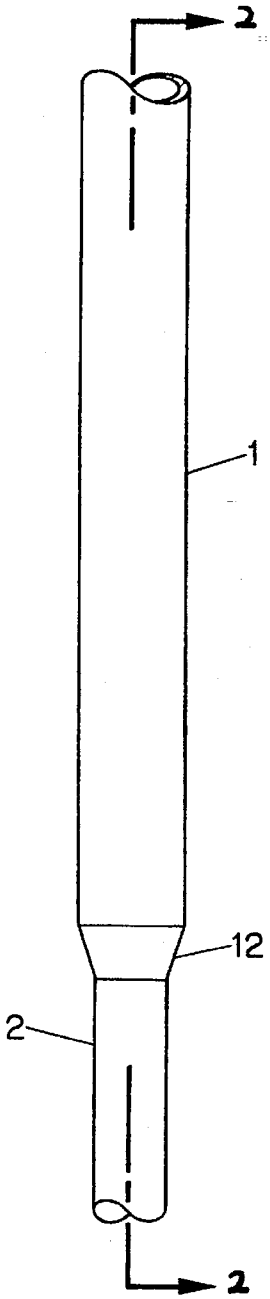
FIG. 1 is a perspective view of the inner and outer tube members.
Figure 13:
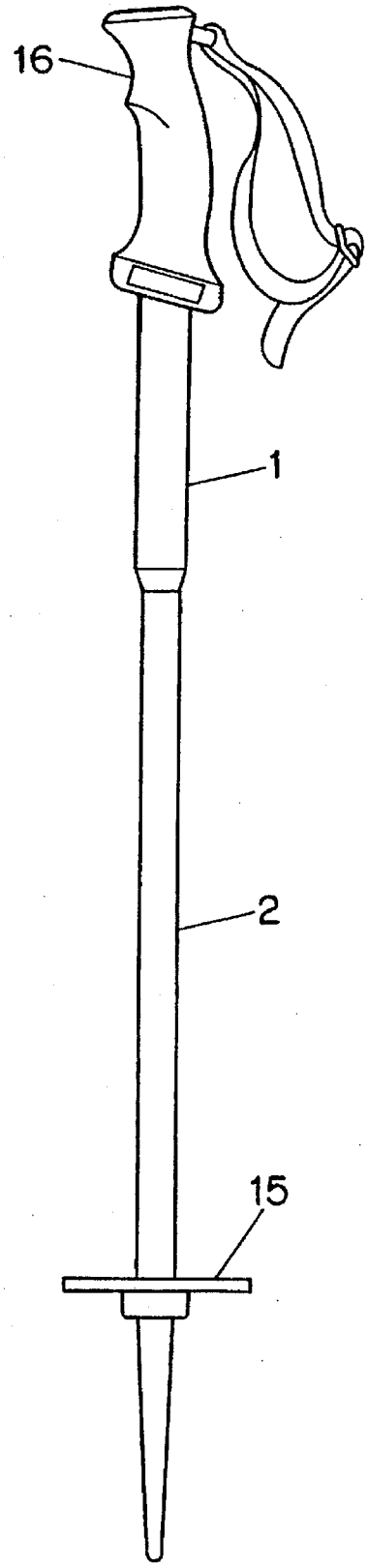
FIG. 13 is a perspective view of the entire ski pole.
Figure 14A:
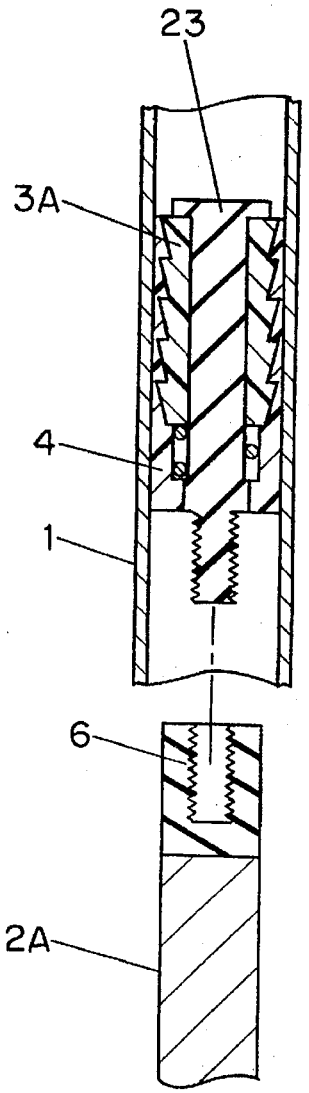
FIG. 14A is a cross section of the embodiment with an oval upper tube taken along the minor axis of the oval and illustrating the male expansion member.
Figure 14B:
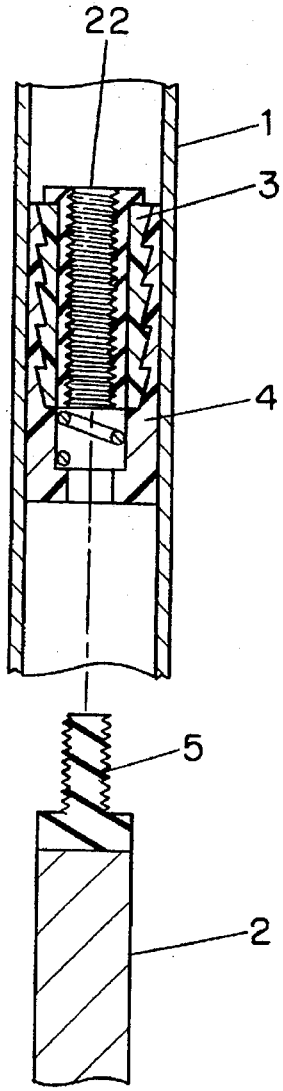
FIG. 14B is a cross section of the embodiment with an oval upper tube taken along the minor axis of the oval and illustrating the female expansion member.
Figure 14C:
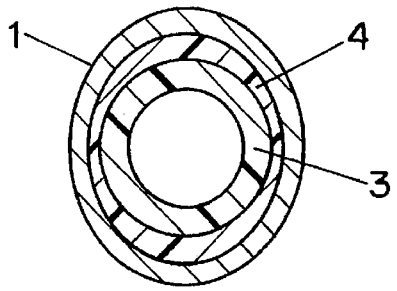
FIG. 14C is a top view of FIG. 14B.
Figure 15A:
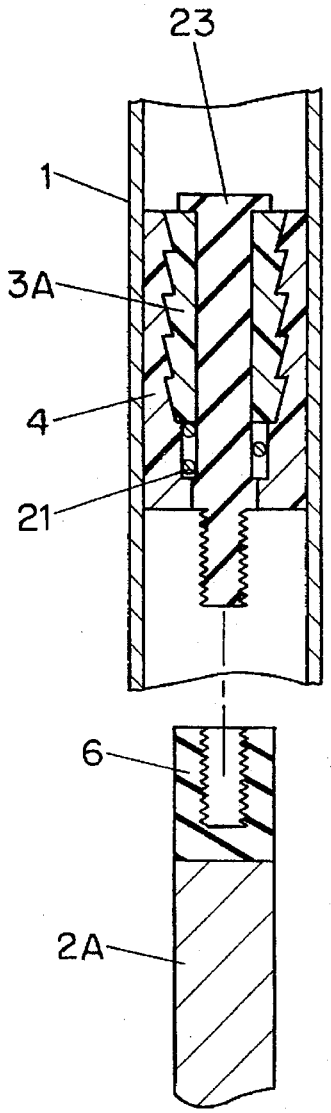
FIG. 15A is a cross section of the embodiment with an oval upper tube taken along the major axis of the oval and illustrating the male expansion member.
Figure 15B:
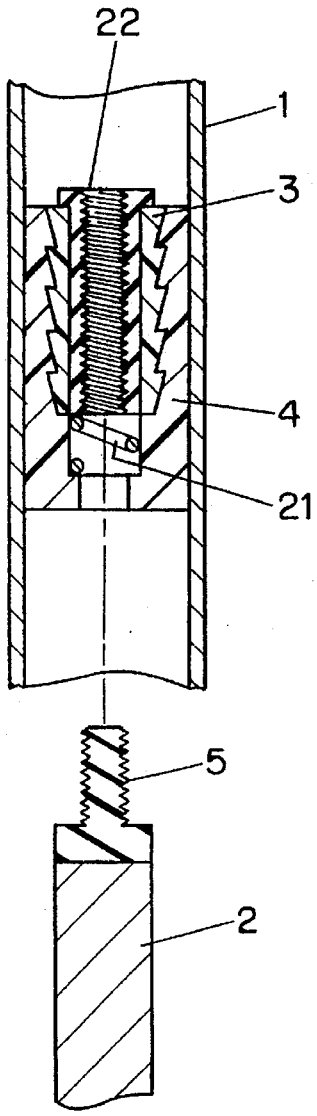
FIG. 15B is a cross section of the embodiment with an oval upper tube taken along the minor axis of the oval and illustrating the female expansion member.
Figure 15C:
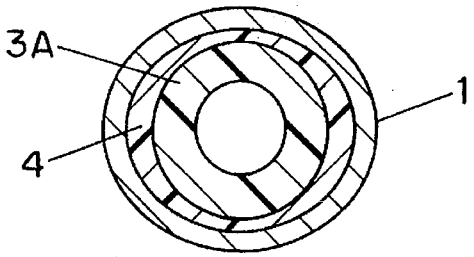
FIG. 15C is a top view of FIG. 15B.

The outer tube member 1 with tapered portion 12 is shown in FIG. 1, with the end of inner tube member 2 inserted within the outer tube member. Inner tube member 2 is slidable up and down within outer tube member 1. In the case of a ski pole shown in FIG. 13, the hand grip 16 is attached to the end of the outer tube member 1 and a removable basket 15 is attached to the far end of the inner tube member 2.

Figure 2:
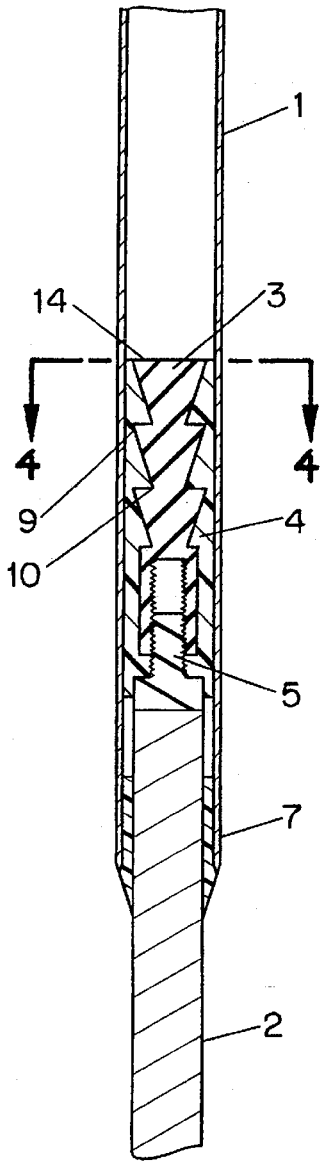
FIG. 2 is a cross-section of the male pole taken along line 2—2 of FIG. 1.
Figure 3:
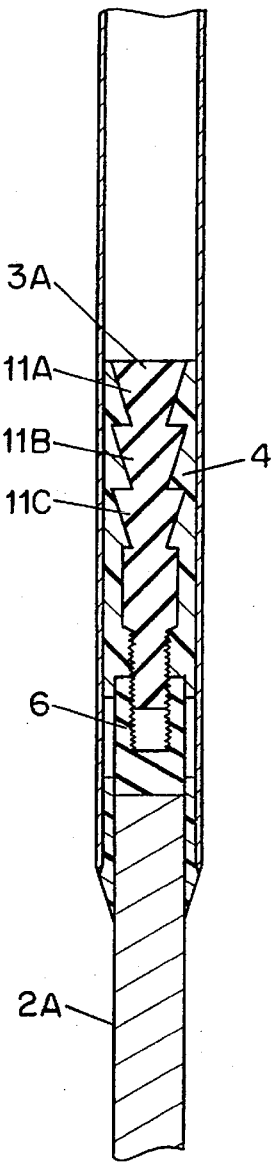
FIG. 3 is a cross-section of the female pole taken along a line similar to 2—2 of FIG. 1.

FIGS. 2 and 3 illustrates the locking mechanism for maintaining the inner tube member in a locked or tightened position relative to the outer tube member. FIG. 2 illustrates the male version of the inner tube member with a corresponding female expansion member 3. FIG. 3 illustrates the female version of the inner tube member with a corresponding male expansion member 3A.

Figure 12:
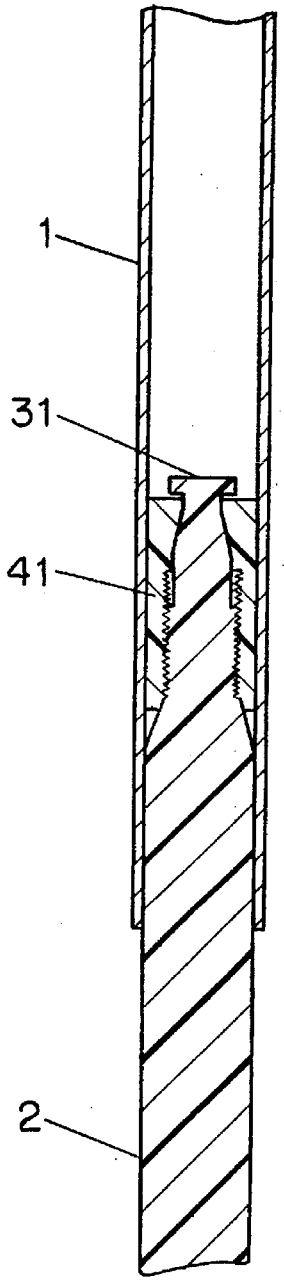
FIG. 12 PRIOR ART
FIG. 12 is a cross-section of a prior art conical expansion locking mechanism made by a company known as Komperdell.

Threaded male member 5 is attached to or part of inner tube member 2 of FIG. 2. Similarly female fitting 6 is attached to or part of inner tube member 2A of FIG. 3. Expansion members 3 and 3A have corresponding male and female members attached to or part of them so that they can be thread into fittings 5 and 6 respectively. Tapered members 11A, 11B and 11C of FIG. 3 are provided as part of expansion members 3 and 3A. The tapered members may be either wedge shaped or conical. Each tapered member has a wide or outermost portion 14 and a narrow or innermost portion 10. Unlike the prior art made by Komperdell fitting shown in FIG. 12, the wide or outermost portions are spaced less than ½ inch from each other. In FIG. 12 the prior art made by Komperdell fitting utilizes a split single piece pressure member 41 which is expanded by the two staged conic expansion member 31 when the inner tube and expansion member are rotated. Since the conical portions of the staged conical member are spaced far apart, there is a certain amount of bending in the pressure member 41 thus decreasing the amount of friction applied to the inner surface of the outer tube. In the instant invention, this bending of the pressure member is minimized due to the proximity of the tapered members 11A, 11B and 11C of the expansion member 3 and the corresponding recesses of the pressure member 4.

Pressure member 4 is shaped to fit on expansion member 3 having recesses and extensions to match the innermost and outermost portions of the tapered members 11A, 11B and 11C. The outer surface of the pressure member meets the inner surface of the outer tube member. When the expansion member is moved downward the friction between the pressure member and the inner surface of the outer tube is increased. It can be seen that the instant invention provides a greater surface area upon which friction is applied that the expansion nut like systems of the prior art made by Komperdell fitting of FIG. 12.

Figure 4:
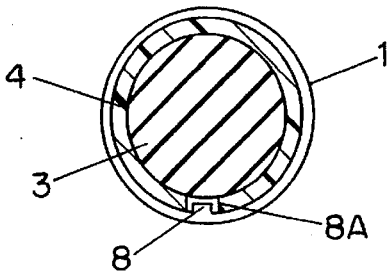
FIG. 4 is a cross-section of the pole of FIG. 2 taken along line 4—4.
Figure 5:
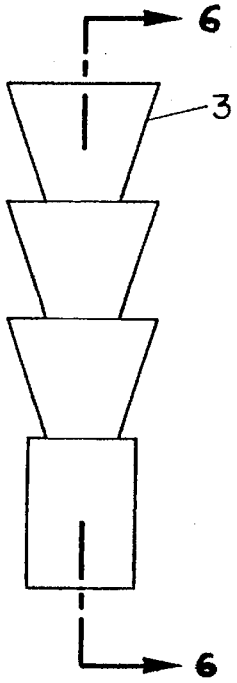
FIG. 5 is a front view of a female conical expansion member.
Figure 6:
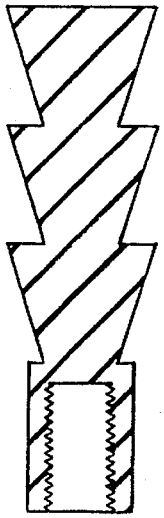
FIG. 6 is a cross-section of the expansion member of FIG. 5 taken along line 6—6.
Figure 7:
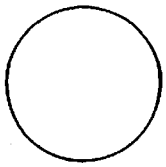
FIG. 7 is a top view of the conical expansion member of FIG. 5.
Figure 8:
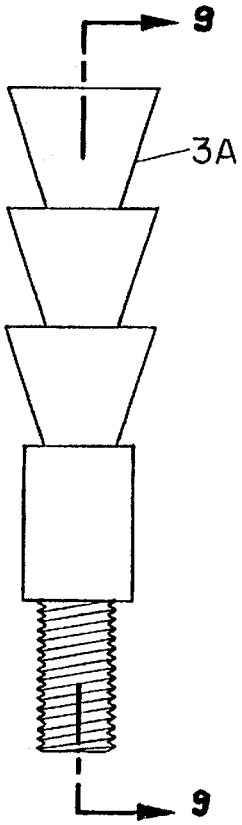
FIG. 8 is a front view of a male conical expansion member.
Figure 9:
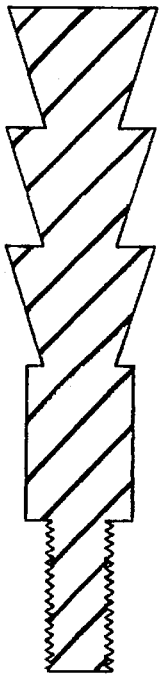
FIG. 9 is a cross-section of the conical expansion member of FIG. 8 taken along line 9—9.
Figure 10:
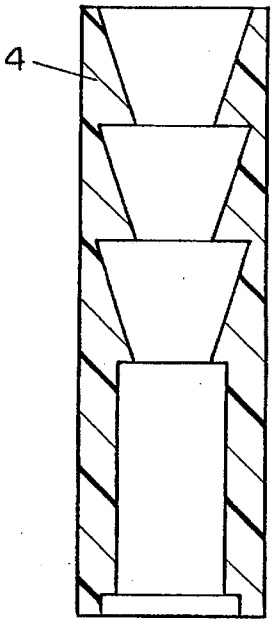
FIG. 10 is a cross-section of one half of the pressure member, the other half being identical.
Figure 11:
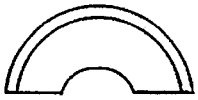
FIG. 11 is a top view of the expansion member of FIG. 10.

As shown in FIG. 4, the outer tube member is provided with a raised seam or key 8. Pressure member 4 is provided with a slot into which raised seam or key 8 fits. This allows the pressure member to slide up and down the outer tube member but prevents the rotation of the pressure member relative to the outer tube member.

It can be seen that when the male or female parts of the inner tube member are completely unthreaded on their respective male or female expansion members there is minimal pressure on the pressure members 4. This allows the inner tube member to be easily slid up or down within the outer tube. However, from this position once the inner tube is rotated to thread the inner tube fitting and the expansion member fitting, the tapered members exert additional pressure on the pressure member 4 which in turn exerts increasing frictional force on the inner surface of the outer tube. The more the inner tube and its attached male or female fitting is threaded, the more friction is applied to the outer tube. Eventually the pressure member is fully expanded. The expansion member is prevented from exiting by stop fitting 7 and the inner tube member with its attached male or female fitting can be separated from the outer tube member. When the fittings are loosened and the inner tube is slid down to the point of stop 7, then further rotation of the inner tube will remove the inner tube member completely from the expansion member by the complete separation of male member 5 from female member 6. Once separated the male and female inner tube members may be attached to each other by threading their male and female fittings. In the case of an avalanche probe, the ski pole grips are attached to the end of the outer tube and thus once the inner tube members are attached to each other, the grips are no longer part of the probe. To complete the conversion into a probe, all that is needed is to remove a basket from one end of one of the inner tube members.

In the oval embodiment shown in FIGS. 14A, 14B, 14C, 15A, 15B and 15C there is a advantage that the oval shape of both the expansion member and the outer tube prevent the internal locking mechanism from rotating within the outer tube making the key and keyway of the round tube embodiment unnecessary and provides more reliable operation. Spring 21 has been added to maintain upward pressure on the expansion member. It has been found that by maintaining such upward pressure helps to avoid inadvertent jamming of the mechanism under certain circumstances. In this embodiment, it can be seen that the outer tube 1 is oval in diameter and the split pressure members 24 are shaped to fit inside such oval, while the male and female expansion members 3A and 3 are still round.

It should be further seen that since the grip 16 fits on the oval outer tube the grip must have a similarly oval shaped inner core.

It will thus be seen that the objects set forth above, among those made apparent from the preceding description, are efficiently attained and, since certain changes may be made in carrying out the above telescoping ski pole without departing from the spirit and scope of the invention, it is intended that all matter contained in the above description and shown in the accompanying drawings shall be interpreted as illustrative and not is a limiting sense.

It is also to be understood that the following claims are intended to cover all of the generic and specific features of the invention which as a matter of language might be said to fall therebetween.

What is claimed is:

1. A locking structure for two telescoping tubular members comprising:

an outer tube member having an inner and outer surface;

an inner tube member slidable inside said outer tube member;

an expansion member within said outer tube member;

said expansion member comprising at least two tapered members each having innermost and outermost portions, said outermost portions being spaced no more than ½ inch from each other;

an outer tube pressure member shaped to fit on said expansion member and disposed between said expansion member and the inner surface of the outer tube member;

means for attaching said expansion member to said inner tube member;

means for moving said expansion member in opposite directions inside said outer tube member so that when said expansion member is moved in a first direction, pressure is directly applied to said outer tube pressure member which in turn applies pressure to the inner surface of the outer tube member thereby maintaining the inner and outer tube members in a locked position, and when said expansion member is moved in the opposite direction, pressure is relieved from said outer tube pressure member which in turn relieves the pressure exerted on the inner surface of the outer tube member thereby loosening the inner and outer tube members from the previously locked or tightened position.

2. The locking structure of claim 1 further comprising means for preventing said outer tube pressure member from rotating within said outer tube.

3. The locking structure of claim 2 further comprising stop means for preventing said expansion member from sliding out of said outer tube member.

4. A locking structure for two telescoping tubular members comprising:

an oval diameter outer tube member having an inner and outer surface;

a round inner tube member slidable inside said outer tube member;

an expansion member within said outer tube member;

said expansion member comprising at least two tapered members each having innermost and outermost portions;

an outer tube pressure member shaped to fit on said expansion member and disposed between said expansion member and the inner surface of the outer tube member and also shaped to fit inside the oval diameter of the outer tube;

means for attaching said expansion member to said inner tube member;

means for moving said expansion member in opposite directions inside said outer tube member so that when said expansion member is moved in a first direction, pressure is directly applied to said outer tube pressure member which in turn applies pressure to the inner surface of the outer tube member thereby maintaining the inner and outer tube members in a locked position, and when said expansion member is moved in the opposite direction, pressure is relieved from said outer tube pressure member which in turn relieves the pressure exerted on the inner surface of the outer tube member thereby loosening the inner and outer tube members from the previously locked or tightened position.

5. The locking structure of claim 4 further comprising means to maintain upward pressure on said expansion means.

6. A first and second ski pole each comprising:

A locking structure for two telescoping tubular members comprising:

an outer tube member having an inner and outer surface;

an inner tube member slidable inside said outer tube member;

an expansion member within said outer tube member;

said expansion member comprising at least two tapered members each having innermost and outermost portions, said outermost portions being spaced no more than ½ inch from each other;

an outer tube pressure member shaped to fit on said expansion member and disposed between said expansion member and the inner surface of the outer tube member;

means for attaching said expansion member to said inner tube member;

means for moving said expansion member in opposite directions inside said outer tube member so that when said expansion member is moved in a first direction, pressure is directly applied to said outer tube pressure member which in turn applies pressure to the inner surface of the outer tube member thereby maintaining the inner and outer tube members in a locked position, and when said expansion member is moved in the opposite direction, pressure is relieved from said outer tube pressure member which in turn relieves the pressure exerted on the inner surface of the outer tube member thereby loosening the inner and outer tube members from the previously locked or tightened position;

wherein said expansion member of said first pole further comprises a threaded female member, and the inner tube member further comprises a male threaded fitting adapted to fit said female member of said expansion member and wherein said expansion member of said second pole comprises a male threaded fitting member, and the inner tube member further comprises a female threaded fitting adapted to fit into both the male threaded fitting of the expansion member of said second pole and the male threaded fitting of the inner tube member of said first pole.

7. A first and second ski pole each comprising:

A locking structure for two telescoping tubular members comprising;

an oval diameter outer tube member having an inner and outer surface;

a round inner tube member slidable inside said outer tube member;

an expansion member within said outer tube member;

said expansion member comprising at least two tapered members each having innermost and outermost portions;

an outer tube pressure member shaped to fit on said expansion member and disposed between said expansion member and the inner surface of the outer tube member and also shaped to fit inside the oval diameter of the outer tube;

means for attaching said expansion member to said inner tube member;

means for moving said expansion member in opposite directions inside said outer tube member so that when said expansion member is moved in a first direction, pressure is directly applied to said outer tube pressure member which in turn applies pressure to the inner surface of the outer tube member thereby maintaining the inner and outer tube members in a locked position, and when said expansion member is moved in the opposite direction, pressure is relieved from said outer tube pressure member which in turn relieves the pressure exerted on the inner surface of the outer tube member thereby loosening the inner and outer tube members from the previously locked or tightened position;

wherein said expansion member of said first pole further comprises a threaded female member, and the inner tube member further comprises a male threaded fitting adapted to fit said female member of said expansion member and and wherein said expansion member of said second pole comprises a male threaded fitting member, and the inner tube member further comprises a female threaded fitting adapted to fit into both the male threaded fitting of the expansion member of said second pole and the male threaded fitting of the inner tube member of said first pole.

* * * * *